United States Patent [19]

Cartwright et al.

[11] 4,265,055

[45] May 5, 1981

[54] METHOD AND APPARATUS FOR FORMING A RAZOR BLADE EDGE

[75] Inventors: Cyril A. Cartwright, Monroe; Anthony J. Peleckis, Jr., Trumbull, both of Conn.

[73] Assignee: Warner-Lambert Company, Morris Plains, N.J.

[21] Appl. No.: 940,693

[22] Filed: Sep. 8, 1978

Related U.S. Application Data

[63] Continuation-in-part of Ser. No. 857,726, Dec. 5, 1977, abandoned, which is a continuation of Ser. No. 633,751, Nov. 20, 1975, abandoned.

[51] Int. Cl.[3] ..... B24B 1/00; B24B 3/48

[52] U.S. Cl. ..... 51/80 B; 51/87 BS; 51/285; 51/395; 76/DIG. 9

[58] Field of Search ..... 51/3, 74 BS, 80 R, 80 BS, 51/80 A, 206 P, 285, 267, 80 B, 298, 395, 87 BS; 76/87, 104, DIG. 8, DIG. 9, 81.7

[56] References Cited

U.S. PATENT DOCUMENTS

| | | | |
|---|---|---|---|
| 1,115,824 | 11/1914 | Jenkins | 76/81.7 X |
| 1,426,083 | 8/1922 | Kampfe | 51/263 |
| 1,936,075 | 11/1933 | Unsinger | 51/80 B |
| 2,709,874 | 6/1955 | Delafontaine | 51/80 B |
| 3,461,616 | 8/1969 | Nissen et al. | 51/87 R |
| 3,682,579 | 8/1972 | Topfer | 51/80 BS |
| 4,142,870 | 3/1979 | Lovejoy | 51/298 |

FOREIGN PATENT DOCUMENTS

| | | | |
|---|---|---|---|
| 626980 | 9/1961 | Canada | 76/81.7 |
| 599199 | 6/1934 | Fed. Rep. of Germany | 51/80 B |

*Primary Examiner*—Othell M. Simpson
*Assistant Examiner*—K. Bradford Adolphson
*Attorney, Agent, or Firm*—Jeremiah J. Duggan; Louis S. Gillow

[57] ABSTRACT

Blade sharpening apparatus including two final honing wheels of substantially cylindrical geometrical configuration. The wheels are nominally five inches in length and six inches in diameter, the diameter of the exit end of the wheel being approximately 0.0015 inches greater than the entrance end. The wheel mounted on either side of a continuous blade strip rotate about parallel axes which are also parallel to the edge of the blade strip. A spiral helix is formed on the surface of each wheel such that when the wheels are intermeshed a nip running along and parallel to the blade edge is formed. The material from which the wheels are fabricated is selected to have sufficient resiliency so as to form a final facet on the blade of substantially convex geometry.

10 Claims, 6 Drawing Figures

METHOD AND APPARATUS FOR FORMING A RAZOR BLADE EDGE

CROSS-REFERENCE TO RELATED APPLICATION

This application is a continuation-in-part of U.S. Application Ser. No. 857,726 filed Dec. 5, 1977, by Cyril A. Cartwright et al for METHOD AND APPARATUS FOR FORMING A RAZOR BLADE EDGE, which was a continuation of U.S. Application Ser. No. 633,751 filed Nov. 20, 1975, both abandoned.

BACKGROUND OF THE INVENTION

The invention relates to apparatus and methods for producing a cutting edge on a razor blade strip of preferred geometry and more particularly the formation of a substantially convex final facet.

Razor blades are generally produced by a series of grinding and honing operations intended to achieve a degree of sharpness and durability consonant with modern standards. U.S. Pat. No. 2,709,874 issued to Delafontaine discloses and illustrates razor blade grinding and honing equipment of the type utilized in the fabrication of razor blades. The equipment disclosed therein may be utilized with modification in the practice of the present invention.

In attempting to minimize possible defects in the formation of the ultimate edge of the razor blade and to achieve greater durability and shaving comfort the prior art has employed various modifications in grinding and honing techniques U.S. Pat. No. 3,461,616 to Nissen et al discloses a method and apparatus intended to produce an improved razor blade conformation. This patent employs a final honing stage in which the honing wheels are dressed to have a substantially hyperbolic frustoconical geometry. The imposition of these wheels against the moving blade strip at an inclined angle of approximately 5 degrees produces a razor blade having a convex final facet, i.e., the included angle of the ultimate edge is some selected maximum value which diminishes in proportion to its distance from such ultimate edge. This geometry presents a continuous relief to the hair as it is being cut. It also provides a stronger blade edge in that the cross-sectional convexity permits increased included angle and commensurate blade thickness nearer the ultimate edge of the blade. This process also minimizes defects known as "spot turn". This defect, which shows itself in a lateral periodic displacement of the ultimate edge from the axial plane of the blade strip, is essentially caused by the unequalized lateral forces exerted on the edge by the trailing or exit edges of the final honing wheels which are helically shaped so as to permit their intermeshing.

The method and apparatus of U.S. Pat. No. 3,461,616 demands use of honing wheels having precise conformance to a particular geometry and which must be precisely aligned at an inclined angle to the path of the blade edge during the grinding process. These requisites add to the expense and complexity of an already difficult process and to this degree are undesirable. Thus, it is an object of the present invention to overcome the disadvantages and complexities of the prior art, and to provide an improved method and apparatus for forming a sharpened blade edge.

Another object of the invention is to provide an improved method and apparatus for producing a stronger razor blade edge.

Another object of the invention is to provide a method and apparatus which minimizes damage to the ultimate edge of the razor blade during the production thereof.

Still another object of the invention is to provide for final honing of the ultimate edge of a razor blade exhibiting increased durability and shaving comfort.

In furtherance of the foregoing objects the present invention contemplates formation of a final facet on the ultimate edge of a razor blade having substantially convex geometry and freedom from defects. Razor blade strip is drawn along a defined path at a controlled linear velocity. Grinding means disposed in this path form a facet on the edge of the strip, and first honing means located on this same path but remote of the grinding means forms a first facet on the strip. The final facet is produced by final honing wheels mounted adjacent to the path of the strip on opposing sides thereof. The wheels have helical circumferential grooves cut therein which when intermeshed form a nip of predetermined axially length parallel to the strip and contiguous therewith. This nip defines a predetermined included angle between the final facets located on opposing sides of the blade strip. The final honing wheels are selected to have sufficient resiliency to produce the desired final facet of substantially convex geometry and minimum edge defects.

BRIEF DESCRIPTION OF A PREFERRED EMBODIMENT

Figure 1:
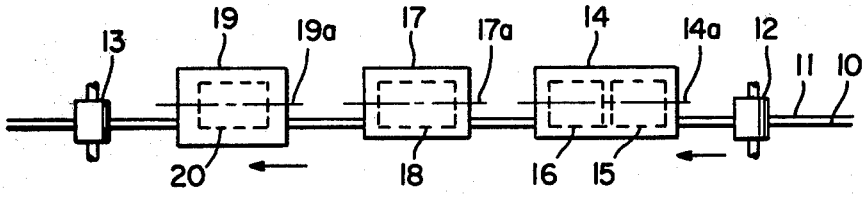
FIG. 1 is a diagrammatic side view of the razor blade sharpening and grinding apparatus.

FIG. 1 shows razor blade 10 in continuous strip form of substantially uniform width conforming in chemical composition to standard stainless steel blade requirements, having only one edge being formed in order to simplify understanding of the fabrication process, it being understood that an essentially mirror image of the apparatus may be employed to form similar edge along the bottom margin. Strip 10 is subjected to grinding operations at stage 14 by a pair of grinding wheels 16 and 15 rotating about axes 14A. A rough or first honing operation is performed at stage 17 by a pair of honing wheels 18 mounted for rotation about axes 17A. A finish or final honing operation is performed at stage 19 by a pair of honing wheels 20 mounted for rotation about axes 19A. Razor blade strip 10 is driven along a defined path at a uniform and controlled velocity by the action of pressure rollers 12 and 13.

The rough grinding operation at stage 14 and the rough honing operation at stage 17 are performed with apparatus of conventional design well known in the art.

In these operations two abrading wheels mounted on opposing sides of razor blade strip 10 are rotated so as to remove material from the blade edge in a generally downward direction, i.e., the wheels both rotate into and down from the edge of blade strip 10. The axes of these wheels 14A and 17A are parallel to each other and parallel to the edge of strip 10. As heretofore indicated, razor grinding equipment of this type is well known in the art, an example of such being contained in U.S. Pat. No. 2,709,874.

Abrading wheels 15, 16 of stage 14 are controlled and geometrically located to grind the edge of strip 10 to a controlled angular rough facet having included angle in the range of 9° and 14°. This rough or grind facet is then smoothed by abrading of finer grit contained in first honing wheel 18, thereby forming a second facet having an included angle in the range of 11° to 17° and a facet depth extending approximately 0.005 inches from edge 11. The first facet is then subjected to a finish honing operation at stage 19 in which blade 10 is subjected to an abrading operation from the ultimate edge back a distance of about 0.001 inches.

Figure 2:
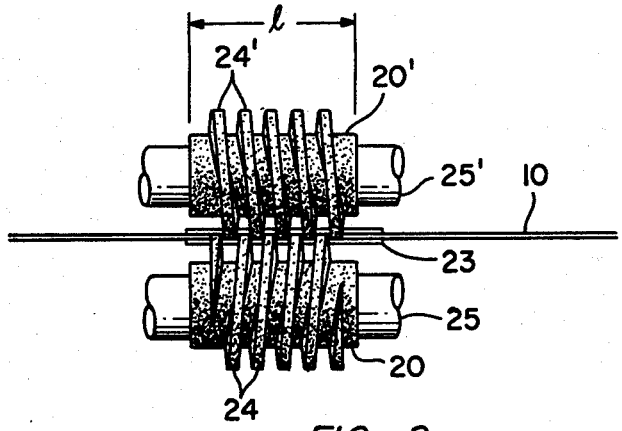
FIG. 2 is a plan view of the final honing wheels relative to the blade strip edge.

The positioning and geometry of final honing wheels 20, 20' are seen or illustrated in FIG. 2. Wheels 20, 20' are parallelly arrayed on either side of blade strip 10. Moreover, although not shown in FIG. 2, axes 17A are maintained parallel to the upper margin of blade strip 10. Wheels 20, 20' are mounted to spindles 25, 25' respectively, which are driven at a desired angular velocity.

The exterior surface of each wheel 20, 20' is formed with spiral helical grooves running their entire axial length, one being a left hand helix and the other right. These grooves form spiral lands 24, 24' on their respective wheels, which lands contain abrasive grit for the removal of material. In practice of the present invention, the composition of wheels 20, 20' is selected to have a desired degree of resiliency. By resiliency is meant a limited resistance to deformation, sufficiently short time constant for return to an undeformed state compatible with the selected angular velocity, and finally a minimum degree of hysteresis. Wheels 20, 20' therefore display a relatively decreased level of resistance to deformation combined with an ability to return substantially to an undeformed state prior to completion of a wheel revolution. In the embodiment of the invention described herein, a wheel conforming to these objectives was fabricated from polyimide No. 2080 of the Upjohn Company, a fully reacted completely aromatic polyimide polymer mixed with a grit comprising an alumina oxide having a 1000 grit size.

Figure 3:
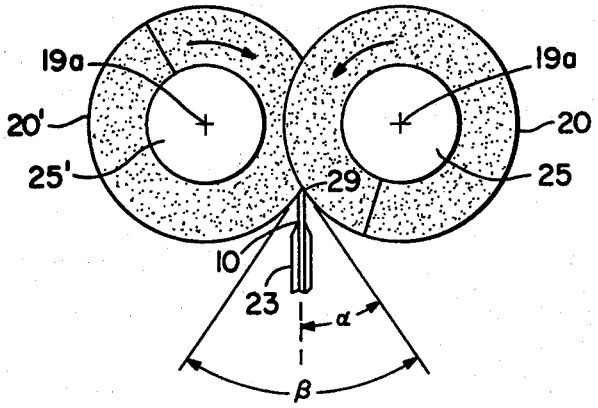
FIG. 3 is an end view of the final honing wheels of FIG. 2.

Referring also to FIG. 3, wheels 20, 20' can be seen rotating in opposite directions toward and down from the upper margin of blade strip 10, which strip is held in position by clamp or clip 23. In accordance with this orientation, material is removed from upper margin 11 of strip 10 in descending fashion. The circumferential perimeters of wheels 20, 20' form nip 29 along their axes, which may be selected to have a desired included angle $\beta$ achievable by displacement of axes 19A in a vertical direction. Wheels 20, 20' have an overall axial length of five inches and a nominal diameter of six inches and have a slight taper which provides an increased diameter of 0.0015 inches at the exit end of the final honing operation. Wheels 20, 20' may be operatd at angular velocities not exceeding 10,000 rpm.

Figure 4:
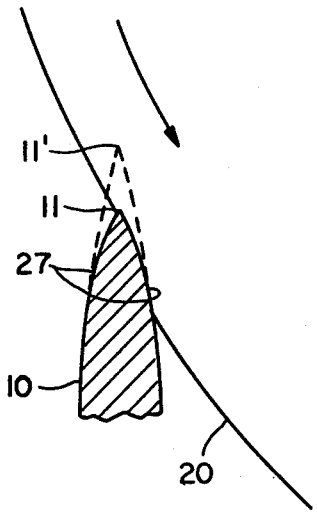
FIG. 4 is a diagrammatic view indicating an hypothesized view of the blade and a honing wheel.
Figure 5:
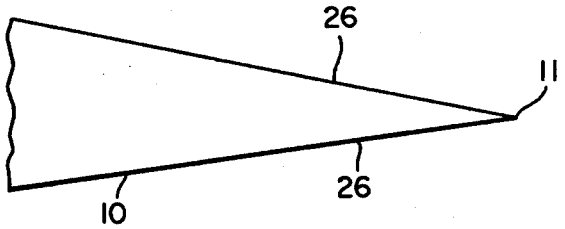
FIG. 5 PRIOR ART
FIG. 5 is a diagrammatic cross-sectional view of a prior art razor blade.
Figure 6:
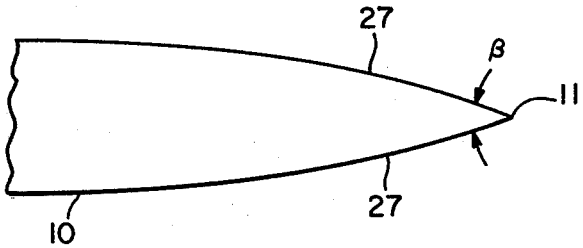
FIG. 6 is a diagrammatic cross-sectional view of a razor blade having a geometry conforming to the present invention.

FIG. 4 shows in diagrammatic form the general orientation of wheel 20 with respect to blade strip 10. It can be seen that if axis 19A of wheel 20 were raised or lowered, the final facet would assume a different angle. The dotted line blade segment 11' indicates the material removed during honing. Prior art honing wheels not possessing the characteristics heretofore described produce a shaving edge similar to that depicted in FIG. 5. Final facets 26 descending from the ultimate edge 11 were either substantially linear geometry or slightly concave, thereby presenting to the severed hair a constant or increasing included angle. Referring to FIG. 6, final facet 27 conforms to that produced by practice of the present invention. Facet 27 has a convex or arch geometry in which the included angle constantly decreases and ultimately substantially blends in with the angle of the first hone facet. Thus, a razor blade of improved geometry is achieved in a simpler less complicated and improved fashion over that heretofore known.

The following samples clearly and distinctly delineate the advantageous results obtained in the practice of the invention described herein. After a pair of final honing wheels were grooved and dressed from a polyimide No. 2080 composite wheel member, three groups of blades were honed by employing various angular velocities and strip 10 speeds. Group 1 blades were manufactured at a rate of 150 blades per minute (a blade being approximately 1.75 inches long) at a spindle speed or angular velocity of 3200 rpm. Group 2 blades were produced at a rate of 150 blades per minute with an angular velocity of 4200 rpm and Group 3 blades were produced at 330 blades per minute with an angular velocity of 4200 rpm. Using a Lietz-Michaelson-Interference microscope, the following geometrical data was obtained:

| | (Microns) Distance From Apex | $\alpha$ Bevel 1 Angle | $\alpha$ Bevel 2 Angle | $\beta$ Total Inc. Angle (1 + 2) | (Microns) Thickness |
|---|---|---|---|---|---|
| Group 1 | 20 | 7°26' | 7°53' | 15°19' | 7.19 |
| | 10 | 9°11' | 8°22' | 17°33' | 4.50 |
| | 5 | 11°56' | 9°15' | 21°11' | 2.98 |
| | 2.5 | 14°49' | 13°23' | 28°12' | 1.81 |
| | 1.25 | 17°43' | 18°53' | 35°37' | 0.95 |
| Group 2 | 20 | 7°38' | 7°36' | 15°14' | 7.48 |
| | 10 | 9°58' | 8°22' | 18°20' | 4.75 |
| | 5 | 12°20' | 9°44' | 22°4' | 2.97 |
| | 2.5 | 15°57' | 12°17' | 28°14' | 2.03 |
| | 1.25 | 20°18' | 17°1' | 37°19' | 0.96 |
| Group 3 | 20 | 7°18' | 7°25' | 14°43' | 7.21 |
| | 10 | 8°37' | 7°53' | 16°30' | 4.38 |
| | 5 | 11°10' | 9°20' | 20°30' | 2.67 |
| | 2.5 | 14°40' | 11°28' | 26°8' | 1.70 |
| | 1.25 | 18°18' | 16°52' | 35°10' | 1.06 |

Additionally, samples were taken from each of three different final honing wheels (#1, #2, #3) for determination of Young's Modulus of elasticity, each of those wheels being a fully reacted completely aromatic polyimide polymer mixed with a grit comprising an alumina oxide having a 1000 grit size and capable of providing the desired general convex geometry to the final hone facet of the blade. Specifically, sample #1 was taken from the wheel used to obtain the blade geometry data appearing above. The Young's Modulus of elasticity was also determined for a fourth sample (#4) obtained from a conventional prior art final honing wheel which is relatively harder and less resilient than samples #1, #2 and #3 and which does not provide the desired convex geometry to the final hone facet of the blade when it is cylindrical and has its axis parallel to the blade strip. This prior art honing wheel is formed of phenolic resin and alumina oxide grit and is believed to be substantially the same, at least insofar as non-resiliency is concerned, as the final hone wheel used in the aforementioned U.S. Pat. No. 2,709,874 to Delafontaine.

The four samples (#1, #2, #3, #4) were a nominal ⅛" in diameter by 1" in length and the resonance technique for determining Young's Modulus, as described in ASTM Standard C 623-71, was used. Measurements were made of the fundamental frequency ($F_1$), first overtone ($F_2$) and fundamental longitudinal resonance ($F_L$), and each was used to calculate Young's Modulus (E). Table 1 summarizes the results.

TABLE 1

| Sample | Average E (PSI) | Std. Dev. (PSI) (of 3 tests) |
|---|---|---|
| A1000-QP-X258 (#1) | $1.18 \times 10^6$ | $.002 \times 10^6$ |
| A1000-SP-X248 (#2) | $1.96 \times 10^6$ | $.002 \times 10^6$ |
| A1000-RP-X258 (#3) | $1.67 \times 10^6$ | $.010 \times 10^6$ |
| AMT-B380F (#4) | $3.46 \times 10^6$ | $.080 \times 10^6$ |

TABLE 2

| Sample | L (in) | D (in) | W (gm) | $F_1$ | $F_2$ | $F_L$ |
|---|---|---|---|---|---|---|
| #1 | 1.011 | .126 | .426 | 8,254 | 21,355 | 38,585 |
| #2 | 1.003 | .127 | .453 | 10,598 | 27,412 | 48,900 |
| #3 | 1.008 | .125 | .420 | 9,741 | 25,315 | 46,220 |
| #4 | 1.006 | .132 | .535 | 13,711 | 35,619 | 63,123 |

Table 3 lists the Young's Modulus values calculated from the formulas for $E_1$, $E_2$ and $E_L$ given in the ASTM Standard C 623-71.

TABLE 3

| Sample | $E_1$ (PSI) | $E_2$ (PSI) | $E_L$ (PSI) |
|---|---|---|---|
| 1 | $1.18 \times 10^6$ | $1.18 \times 10^6$ | $1.17 \times 10^6$ |
| 2 | $1.96 \times 10^6$ | $1.96 \times 10^6$ | $1.96 \times 10^6$ |
| 3 | $1.66 \times 10^6$ | $1.67 \times 10^6$ | $1.68 \times 10^6$ |
| 4 | $3.38 \times 10^6$ | $3.43 \times 10^6$ | $3.58 \times 10^6$ |

The lower the value E of Young's Modulus, the more compliant or resilient the material. Accordingly, the resiliency needed to provide a generally acceptable convex geometry to the final hone facet of the blade is clearly indicated to have a Young's Modulus of less than about $3\times10^6$ PSI, probably less than about $2.5\times10^6$ PSI, and preferably in the range of about $1\times10^6$–$2\times10^6$ PSI. In fact, sample #3 was seen to provide the most preferred convex geometry to the final hone facet, with samples #1 and #2 providing convex geometries nearly as desirable and certainly acceptable.

Prior to using final honing wheels 20, 20', it is desirable after they have been helically grooved to chamfer corners of lands 24, 24' thereby minimizing the effect of transition between adjacent lands when the wheels are intermeshed and in contact with ultimate edge 11 of blade strip 10. It is further desirable to condition the honing wheels 20, 20' by operating them under a relatively heavy feed condition on a series of blades prior to actual use in the practice of the novel honing operation. In using wheels having the desired resiliency and preferred grit size, it has been found that the preconditioning or break-in period is considerably shortened over that of prior art harder and less resilient final honing wheels.

As heretofore indicated, this novel honing operation provides a curved final facet configuration of the type demonstrated in FIG. 6 and may be used to provide a range of included angles $\beta$ from upwards of 38° at the ultimate edge continually decreasing proportionately to the distance from the ultimate edge to an angle of approximately 9°. The final facet surfaces produced by this apparatus and method are smoothly curved convex surfaces free of any major distortion, i.e., effectively eliminating any "spot turn" defects. While the exact mechanism by which this convex surface is produced is not understood, it is hypothesized that as the honing wheel surface comes into contact and interferes with upper margin of blade strip 10 it resiliently deforms as indicated in FIG. 4 in a concave manner, thereby generating the desired convexity. It is this characteristic resiliency which, although alterable by variations in operating parameters and blade materials, must be incorporated into the final honing wheel structure if the novel attributes of this invention are to be achieved, and, while a particular embodiment has been illustrated and described, those various modifications which are obvious to one of skill in the art are intended to be within the spirit and scope of the invention as defined in the claims.

What is claimed is:

1. Apparatus for sharpening a razor blade comprising:

means for drawing a razor blade strip along a defined path at a controlled linear velocity;

grinding means disposed in the path of the strip for forming a grind facet on an edge thereof;

first honing means located on the path remote of the grinding means for forming a first hone facet on the strip; and two final resilient substantially cylindrical honing wheels located adjacent the strip each mounted on opposing sides of the strip having their axes parallel thereto and helical circumferential axially advancing grooves formed therein to permit the wheels to intermesh creating a nip of predetermined axial length and included angle parallel to the strip and contiguous therewith, the Young's Modulus value of said honing wheels being less than about $3\times10^6$ pounds per square inch, means for rotating the wheels in opposing directions into the edge of the strip and then away from the strip adjacent a remaining portion thereof and abrading the strip so that the final hone facet thereby formed is of substantially convex geometry and the blade edge is free from periodic lateral deformation.

2. The apparatus of claim 1 wherein the Young's Modulus value of said honing wheels is less than about $2.5\times10^6$ pounds per square inch.

3. The apparatus of claim 1 wherein the Young's Modulus value of said honing wheels is in the range of about $1\times10^6$–$2\times10^6$ pounds per square inch.

4. The apparatus of claim 1 wherein the nip is approximately five inches long, and the included angle is less than approximately 38°.

5. The apparatus of claim 4 wherein the wheels resiliently deform, rapidly return to an undeformed condition and have minimal hysteresis.

6. The apparatus of claim 5 wherein the wheels comprise fully reacted completely aromatic polyimide polymer mixed with an abrasive grit.

7. The apparatus of claim 6 wherein the grit comprises alumina oxide having a 1000 grit size.

8. The apparatus of claim 7 wherein the wheels are approximately five inches long, have a diameter of approximately six inches and are rotated in opposing directions at an angular speed of less than 10,000 rpm, and each wheel abrasively removes material in descending fashion from the blade edge.

9. The apparatus of claim 8 wherein the angular speed is between approximately 3000 rpm and 4500 rpm.

10. A method for sharpening a razor blade comprising the steps of:

drawing a razor blade strip along a defined path at a controlled linear velocity forming a facet of predetermined included angle along an edge of the strip;

honing another facet of increased included angle on the strip; and then final honing a final facet on the strip with two resilient substantially cylindrical honing wheels located adjacent the strip each mounted on opposing sides of the strip having the axes parallel thereto and helical circumferential axially advancing grooves formed therein to permit the wheels to intermesh creating a nip of predetermined axial length and included angle parallel to the strip and contiguous therewith, the Young's Modulus value of said honing wheels being less than about $3\times10^6$ pounds per square inch, by rotating the wheels in opposing directions into the edge of the strip and then away from the strip adjacent a remaining portion thereof thereby abrading the strip so that the final facet is of substantially convex geometry and the blade edge is free from deformation.

* * * * *